US008341955B2

(12) United States Patent
Brantley et al.

(10) Patent No.: US 8,341,955 B2
(45) Date of Patent: Jan. 1, 2013

(54) HYDRAULIC DRIVE AND CONTROL SYSTEM FOR PUMPS USING A CHARGE PUMP

(76) Inventors: Daniel R. Brantley, Williamsburg, MI (US); Ivars R. Bergs, Belmont, MI (US); Jeffrey J. Sietsema, Jenison, MI (US); Michael J. Brennan, Comstock Park, MI (US)

( * ) Notice: Subject to any disclaimer, the term of this patent is extended or adjusted under 35 U.S.C. 154(b) by 380 days.

(21) Appl. No.: 12/803,181

(22) Filed: Jun. 21, 2010

(65) Prior Publication Data

US 2010/0329892 A1 Dec. 30, 2010

Related U.S. Application Data

(60) Provisional application No. 61/269,801, filed on Jun. 29, 2009.

(51) Int. Cl.
*F04B 9/10* (2006.01)
*F04B 17/05* (2006.01)
*F04B 23/04* (2006.01)

(52) U.S. Cl. ..... 60/444; 60/484; 417/380; 417/382; 417/390

(58) Field of Classification Search ..... 417/375, 417/381, 390; 60/484, 443, 444; 91/505
See application file for complete search history.

(56) References Cited

U.S. PATENT DOCUMENTS

| | | | | | |
|---|---|---|---|---|---|
| 2,286,358 | A | * | 6/1942 | Geiger | 60/382 |
| 3,653,208 | A | * | 4/1972 | Kubik | 60/444 |
| 3,744,375 | A | * | 7/1973 | Kubik | 60/433 |
| 3,853,272 | A | * | 12/1974 | Decker et al. | 239/155 |
| 4,177,017 | A | | 12/1979 | Schultz | |
| 4,373,864 | A | | 2/1983 | Massey et al. | |
| 4,416,590 | A | * | 11/1983 | Colucci | 417/231 |
| 4,669,266 | A | * | 6/1987 | Kubik | 60/422 |
| 4,939,981 | A | | 7/1990 | Maki et al. | |
| 5,222,875 | A | * | 6/1993 | Clark | 417/390 |
| 5,561,979 | A | | 10/1996 | Coutant et al. | |
| 6,551,073 | B1 | * | 4/2003 | O'Sullivan | 417/234 |
| 7,053,498 | B1 | | 5/2006 | Boisvert et al. | |

OTHER PUBLICATIONS

The International Search Report and The Written Opinion of the International Searching Authority, or the Declaration, Completed Nov. 18, 2011, Mailed Nov. 30, 2011.

* cited by examiner

*Primary Examiner* — Devon Kramer
*Assistant Examiner* — Nathan Zollinger
(74) *Attorney, Agent, or Firm* — Miller Canfield Paddock and Stone; Mark L Maki

(57) ABSTRACT

A pumping system is provided which is a mobile, vehicle-mounted pumping system, such as for water or fuels, which mounts on a vehicle and may be used for various applications. The pumping system operates a drive system and control system for liquid pumps almost exclusively by hydraulic fluid pressure.

20 Claims, 6 Drawing Sheets

HYDRAULIC DRIVE AND CONTROL SYSTEM FOR PUMPS USING A CHARGE PUMP

CROSS REFERENCE TO RELATED APPLICATION

This application claims the benefit of U.S. Provisional Application Ser. No. 61/269,801, filed Jun. 29, 2009, which is incorporated herein by reference in its entirety.

FIELD OF THE INVENTION

The invention relates to a hydraulic drive and control system for a system of positive displacement pumps, and more particularly, to a system which uses a hydraulic drive system as well as a fully hydraulic control system which maintains the outlet pressure discharged from the pumps.

BACKGROUND OF THE INVENTION

It is known to provide pumping systems for use in mobile applications such as vehicle-mounted pumping systems. An example of one such system is disclosed in U.S. Pat. No. 6,551,073 B1 (O'Sullivan) which discloses a pumping system typically used on a fire truck. In this application, the vehicle is provided with a hydraulic drive system wherein a liquid pump for pumping water is driven by a fixed displacement hydraulic motor, which motor is in turn driven by a variable displacement hydraulic pump. A controller is provided to modulate hydraulic output of the variable displacement hydraulic pump to maintain a constant liquid pressure at the outlet of the water pump. The system uses an electronic control system comprising a motor speed transducer for the hydraulic motor and a liquid outlet pressure transducer, which transducers are connected to an electronic controller device that thereby varies the output of the variable displacement hydraulic pump to vary the liquid pressure and control the motor speed. However, the system may be undesirable since fluctuations in the liquid outlet pressure may occur which may make it difficult to quickly make corresponding changes in the variable displacement hydraulic pump. Further, the electronic control system may be subject to failure, particularly in hostile environments wherein an electronic control system may be difficult to maintain.

It is an object of the invention to provide an improved pumping system for mobile applications, particularly where a pumping system is provided on vehicles such as a trailer or the like. Further, it is an object of the invention to provide a pumping system which provides an improved control of the liquid outlet pressure supplied by a fluid pump, and provide a system which is particularly suitable for hostile environments which require a stable drive system for the pumps as well as a control system therefor.

The pumping system of the invention is a mobile, vehicle-mounted pumping system, such as for water, fuels or other suitable liquids, which mounts on a trailer and may be used for various applications where it is necessary to pump fluids, such as a variety of liquids from remote and/or temporary storage tanks and facilities. While the following summary may reference liquid pumps for convenience, any of a variety of process fluids may be pumped or distributed by fluid distribution equipment. The system comprises one or more fluid or liquid pumps which are connected to and driven by a drive system for the pumps and by a control system for controlling the outlet pressure of the liquid or process fluid being discharged from the pumps.

The pumping system operates the drive system and the control system almost exclusively by hydraulic fluid pressure which avoids the necessity of an electronic control system to control the pump outlet pressure which may be more complex to maintain and susceptible to failure, particularly in harsh, hostile or remote environments.

The main system components are a diesel engine, one or more fluid pumps for distributing the process fluid, which pumps preferably are each driven by a hydraulic motor, a hydraulic drive system, which generates hydraulic fluid pressure to drive each motor, and a hydraulic control system, which controls and varies the output of the process fluid pressure of the liquid pumps by varying the pressure of the hydraulic fluid that drives each hydraulic motor. The process fluid pumps preferably are positive displacement pumps which pump liquids as the process fluid.

To generate the hydraulic system pressure, a drive shaft of the diesel engine is connected to and drives a variable displacement hydraulic pump, i.e. a main pump, wherein the pump output is the system pressure that is supplied to and drives the hydraulic motors. The main pump has a variable output that selectively varies the system pressure generated thereby to thereby vary the motor operation which in turn, varies the pump output from the fluid pumps. The pumping system operates upon the principal that the system pressure driving the motors directly corresponds to or is proportional to the liquid output pressure in the fluid distribution system. For example, 5200 psi of hydraulic system pressure supplied to the hydraulic motor generates an outlet pressure from the liquid pump of 150 psi. A controlled reduction in the system pressure correspondingly reduces the fluid pump outlet pressure such that controlling the hydraulic system pressure driving the motors also controls the fluid pressure that is output from the pumps.

The output of the main pump is controlled mechanically by a swash plate wherein the position of the swash plate is selectively moved to vary the pump displacement and outlet pressure generated by the main pump when driven by the diesel engine. Preferably, the output of the main pump is accomplished by destroking the main pump. The invention comprises the method and system for moving the swash plate to control the system pressure and thereby control the fluid pump output and vary the liquid output pressure supplied to the distribution system.

The swash plate is mechanically moved by a swash plate control which is a pressure balancing solenoid that is pressurized on one side by a low charge pressure supplied by a charge pump which charge pump is also driven by the diesel engine. The pressure balancing solenoid is pressurized on a second side by a variable control pressure which preferably is a destroking pressure that destrokes the main pump to vary its output. This control pressure is manually adjustable by a system control valve to set the maximum system pressure and maintain such pressure. This system control valve receives the high system pressure from the outlet of the main pump and has a manually rotatable valve wherein a control knob is rotated to set the max system pressure. In this regard, the control valve is adjusted which essentially generates an adjusted pressure exiting the control valve which is fed to the swash plate control solenoid as the destroke pressure to vary the swash plate in a manner that quickly varies the system pressure that is output from the main pump in correspondence to the adjusted destroke pressure supplied to the solenoid.

Initially, the charge pressure supplied to the pressure balancing solenoid moves the swash plate so that the pump is at full stroke. Once the system pressure builds and opens the sequence valve, the control pressure or destroke pressure is supplied to the swash plate control to destroke the main pump away from full stroke to stabilize the system pressure at the max system pressure governed by the system control or sequence valve.

For example, the system pressure may be 5200 psi but the system control valve is adjusted to reduce this maximum system pressure to 4200 psi as the adjusted maximum system pressure. The adjusted pressure is at a high pressure and is supplied to a pressure reducer so that a reduced control pressure is usable in the pressure balancing solenoid in conjunction with the lower pressure generated by the charge pump wherein the relative magnitudes of the control pressure and charge pressure vary the swash plate position. This reduced control pressure is fed to the swash plate control and balances with the charge pressure from the charge pump. Preferably, the control pressure destrokes the pump so as to operate as a destroke pressure. The swash plate control therefore has two balanced pressures which find equilibrium by movement of a spring-biased piston in the swash plate control which piston then mechanically moves the swash plate to control the output displacement of the main pump.

As the swash plate moves, it lowers the pump output pressure from the main pump which thereby reduces the pressure to the motors which in turn reduces the outlet pressure of the liquid pump. Hence, by manually adjusting the system control valve by rotating the knob, the system pressure driving the motors is raised or lowered which thereby raises or lowers the outlet pressure of the liquid pump.

In this manner, the system of driving and controlling the water pumps is all hydraulic and virtually no electronic controls are required to operate the system at a set outlet pressure. While some electronics may be provided primarily for system monitoring and safety shutoff, such electronics may be omitted or disabled for various reasons and the pumping system will continue to operate. Also, this is a fast reacting system. When water valves or other process valves of the fluid distribution system are closed downstream of the liquid pumps by an operator, this dramatically stops the liquid flow yet there is no pressure surge in the system that would be caused if the pumps kept operating after the process valve was closed. This is a particular concern for positive displacement pumps which differ from centrifugal pumps.

Other objects and purposes of the invention, and variations thereof, will be apparent upon reading the following specification and inspecting the accompanying drawings.

Figure 1A:
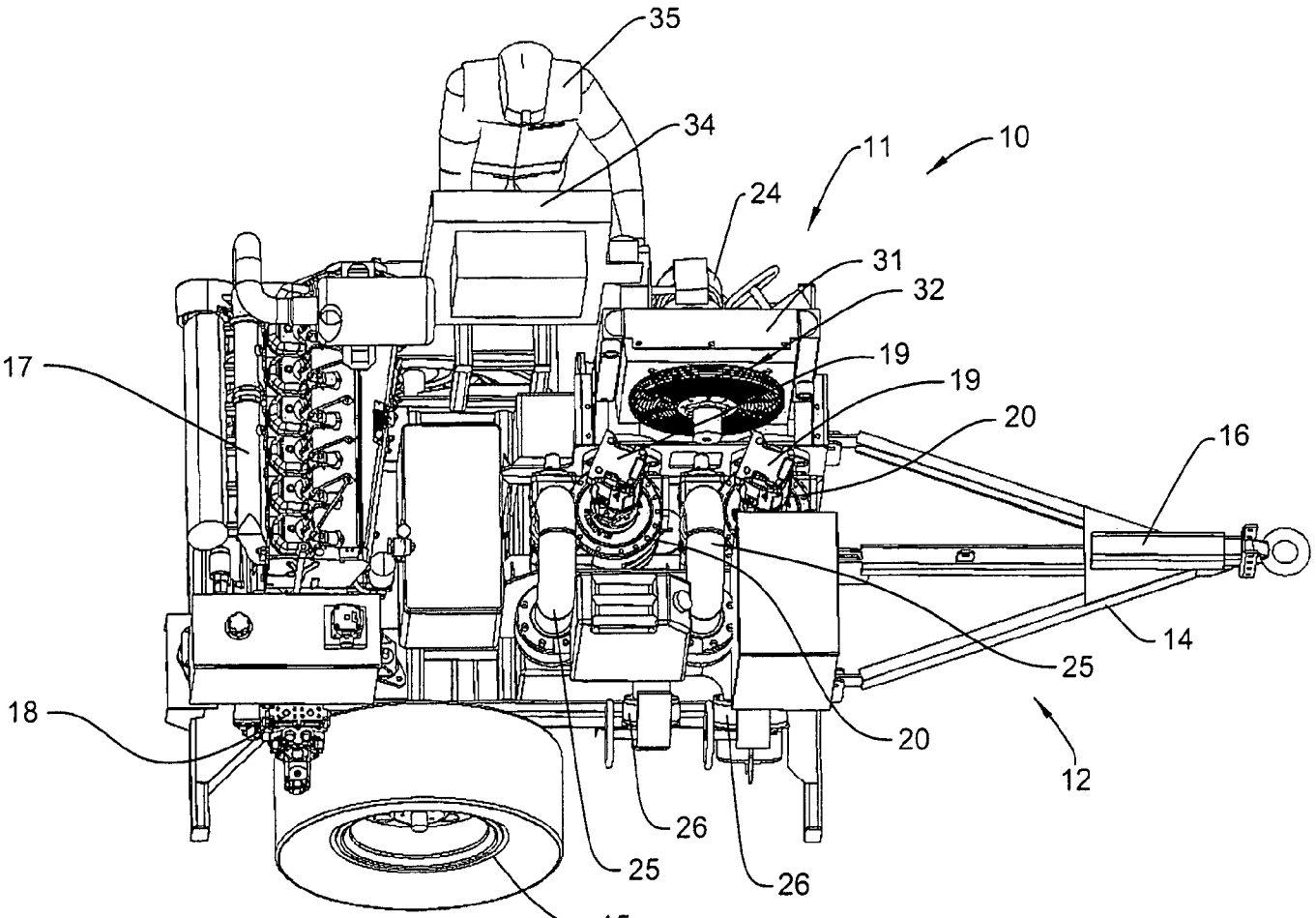
FIG. 1A is a perspective view of a mobile, trailer-mounted pumping system of the invention.

Certain terminology will be used in the following description for convenience and reference only, and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the arrangement and designated parts thereof. Said terminology will include the words specifically mentioned, derivatives thereof, and words of similar import.

DETAILED DESCRIPTION

Referring to FIG. 1A, the invention relates to a fluid handling system 10 and more particularly, to a mobile pumping system 11 for use in distributing fluids, such as water, fuels or other suitable liquids. The mobile pumping system 11 is usable for various applications where it is necessary to pump fluids from remote and/or temporary storage tanks and facilities. The pumping system 11 preferably is mountable to a vehicle 12 and is a self-contained system which does not require external power sources or controls.

More particularly, the vehicle 12 preferably is a trailer comprising a trailer frame 14 having wheels 15 allowing for transport of the pumping system 11 between fluid storage sites or facilities. The pumping system 11 in particular is mounted to the trailer frame and transportable on a secondary vehicle by the hitch portion 16. It will be understood that the pumping system 11 may also have uses and applications wherein the system is mounted on a self-propelled vehicle such as a truck or the like. This pumping system 11 is adapted to be removably connected to other components of the fluid distribution system such as pipe couplings and a liquid or fuel storage tank or other fluid source from which a fluid is received and then pumped by the pumping system 11 downstream to a fluid distribution location. For example, the fluid most preferably is a liquid such as water or fuel which may then be pumped for various uses from a storage tank.

Figure 1B:
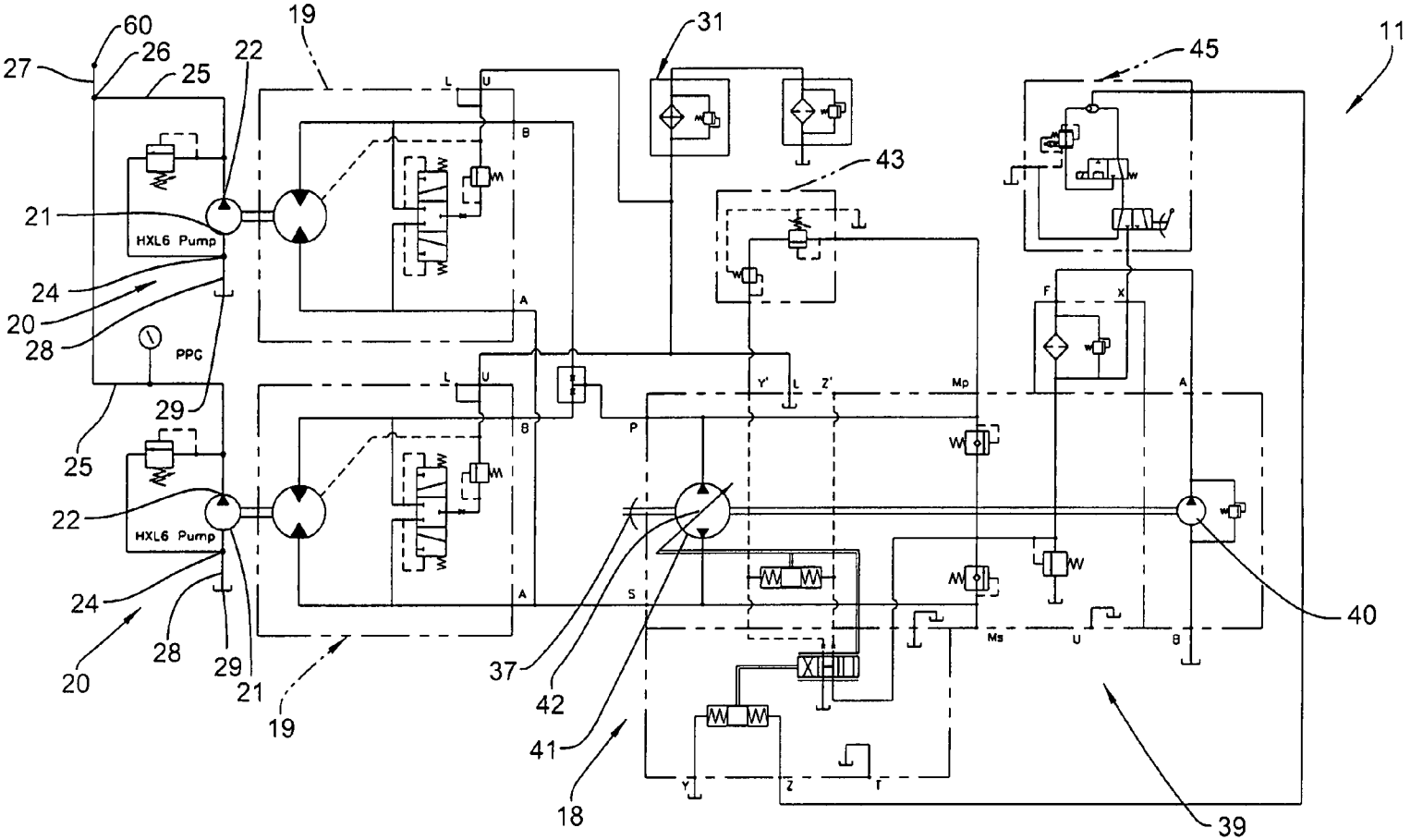
FIG. 1B is a schematic diagram illustrating fluid pumps which are driven by the hydraulic drive and control system therefor.

FIG. 1A is a pictorial view of the overall fluid handling system 10 while FIG. 1B is a hydraulic schematic diagram of the pumping system 11 as such is mounted on the vehicle 12. Generally as to the pumping system 11, such system includes a diesel engine 17 which defines a self-contained power source including its own fuel supply so as to be fully functional and operational. The power source also may be another type of equipment providing rotational energy to the shaft 37 such as an electric motor, gas engine or the like.

The diesel engine 17 in turn is connected to the main pump assembly 18 which is rotatably driven by the engine 17 to generate a hydraulic pressure that is used to drive additional components of the system. Further, the main pump assembly 18 generates such hydraulic pressure so as to drive one or more hydraulic motors 19 which each drive a fluid distribution component that preferably is a fluid pump 20 that is rotatably driven by its hydraulic motor 19. The fluid pumps 20 preferably are positive displacement pumps which receive a process fluid through a respective inlet 21 and discharge such process fluid through an outlet 22 (FIG. 1B). The inlet 21 of each fluid pump 20 receives fluid from an inlet pipe 24, which pipe 24 has a coupler which in use would be removably connected to supply hoses, pipes or the like 28 (FIG. 1B) for receiving fluid from a storage tank 29 or other similar fluid source or supply. The pump outlets 22 in turn connect to outlet pipes 25 having couplers or couplings 25 for removable connection to fluid distribution piping, hoses or the like 27 (FIG. 1B) which distribute the pump fluid to particular applications such as for water supply or fuel supply.

As will be described further herein, the pumping system 11 also includes a heat exchanger 31 cooled by an engine-driven fan 32, and a control panel 34 from which an operator 35 can control operation of the engine 17 and the remaining components of the pumping system 11.

In operation, the internal combustion engine 17 has a drive shaft 37 shown in FIG. 1B which is drivingly connected to the main pump assembly 18 to generate a system pressure that drives the hydraulic motors 19. The motors 19 in turn drive the fluid pumps 20 to generate an outlet pressure discharge from the outlets 22 of the fluid pumps 20 by which the process fluid is distributed through the outlet pipes 25. The main pump assembly 18 and its connections to the hydraulic motors 19 generally define a hydraulic drive system that generates a hydraulic fluid pressure to drive each motor 19.

Further, the main pump assembly 18 includes a hydraulic control system 39 which comprises a charge pump 40 rotatably driven by the drive shaft 37 to generate a control pressure used by the control system 39 to control operation of the main pump assembly 18 and thereby control the hydraulic system pressure generated from the main pump assembly 18. In this regard, the main pump assembly 18 also includes a variable displacement hydraulic pump defining a main system pump 41 which is driven by the drive shaft 37. The main pump 41 has an adjustable pump output which defines the system pressure that is supplied to and drives the hydraulic motor units 19. This main pump 41 has a variable output that selectively varies the system pressure generated thereby to thereby vary the motor operation, which in turn varies the pump output of the process fluid. The pumping system 11 of the invention operates upon the principle that the system pressure driving the motor units 19 directly corresponds to or is proportional to the fluid output pressure at the outlets 22 of the fluid pumps 20. Controlled reductions or increases in the system pressure correspondingly reduces or increases the pump outlet pressure such that controlling the hydraulic system pressure driving the motor units 19 also controls the fluid pressure output from the fluid pumps 20. To vary the main pump output, the variable displacement main pump 41 has a swash plate 42 by which the pump displacement is adjusted. The control system 39 also comprises a control manifold 43 which permits adjustment of the maximum system pressure by governing the displacement of the swash plate 42, preferably by destroking the swash plate, which thereby varies the system pressure and varies the fluid pump output.

Figure 3:
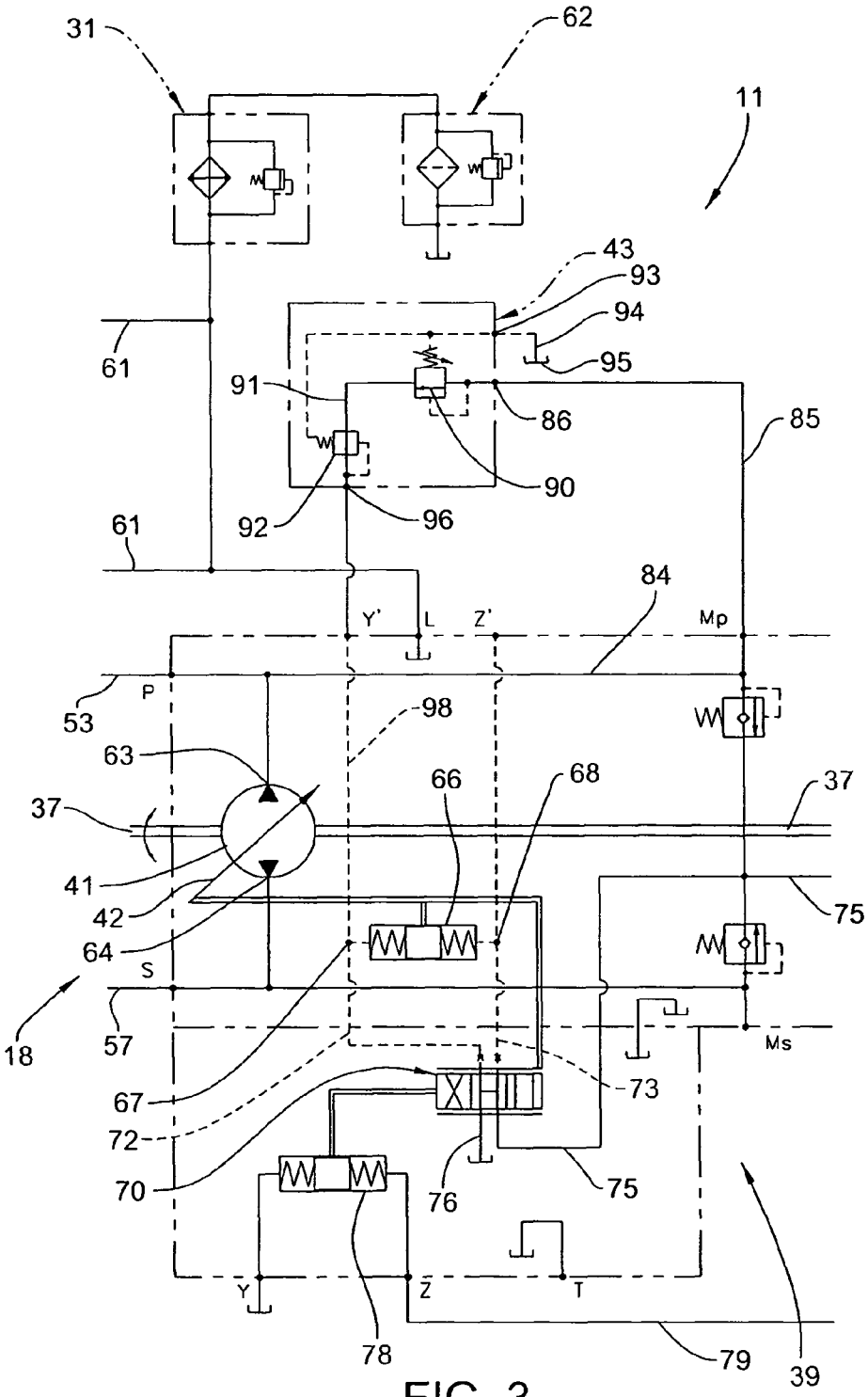
FIG. 3 is an enlarged partial view of the schematic diagram of FIG. 1 illustrating a variable displacement main pump for driving the hydraulic motors and a hydraulic control system therefor.
Figure 4:
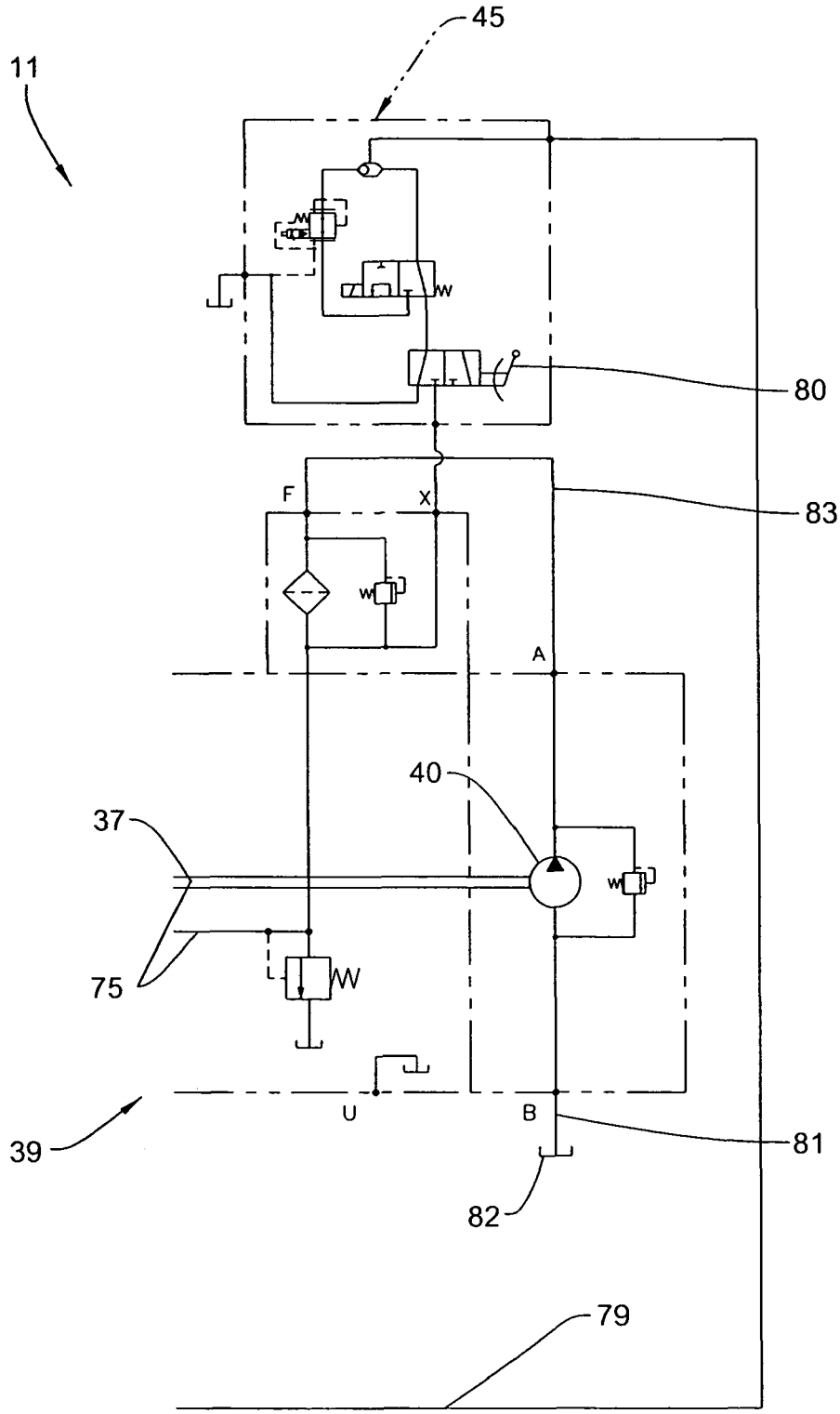
FIG. 4 is an enlarged partial view of the schematic diagram of FIG. 1 illustrating the configuration of a charge pump provided in combination with the main pump.

To hydraulically turn the main pump assembly 18 on and off, an actuator assembly 45 is connected to the main pump assembly 18. The following discussion more specifically describes the components of the schematic diagram of FIG. 1B and the operation thereof, wherein FIGS. 2-4 are enlarged partial sections of FIG. 1B.

Figure 2:
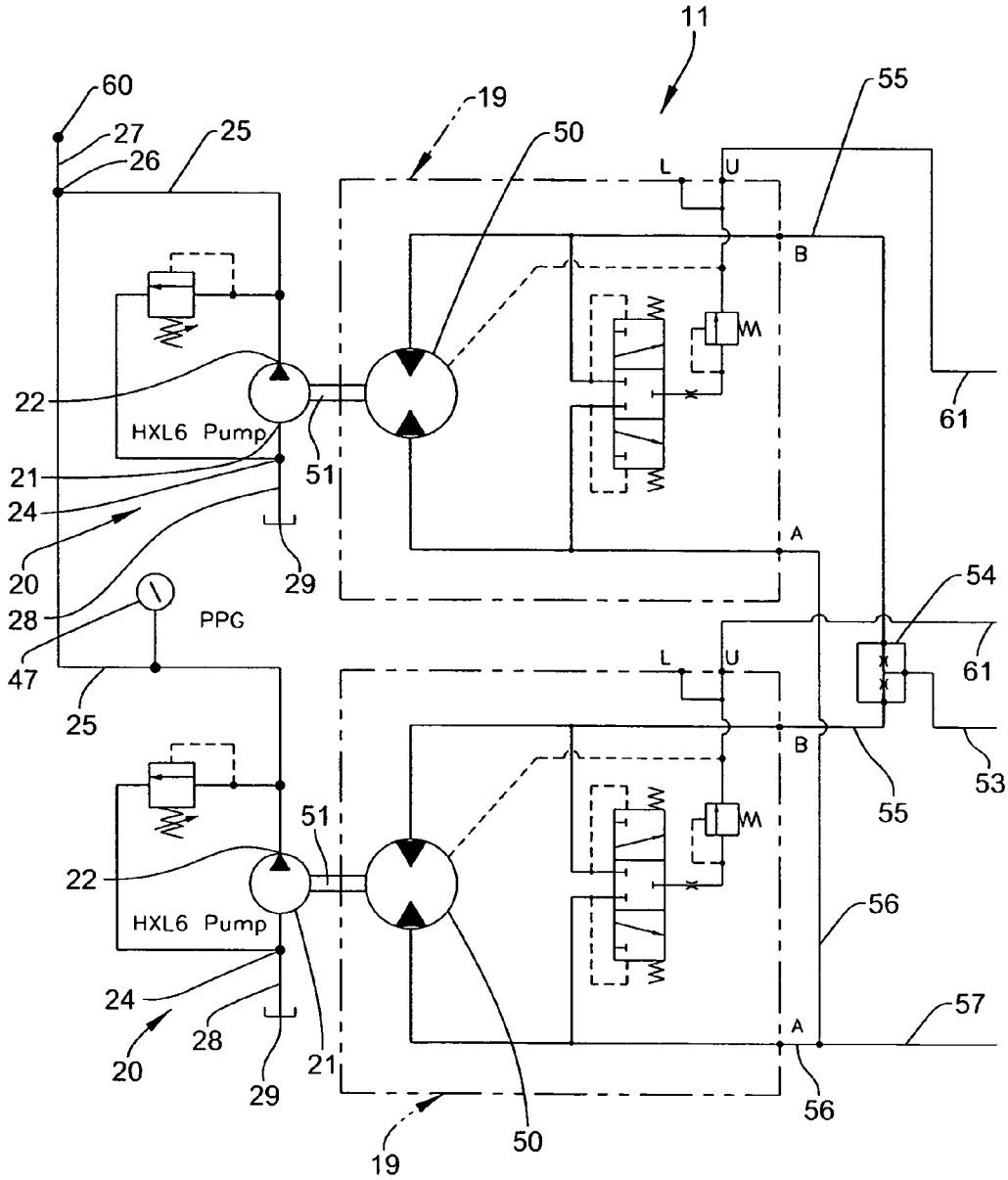
FIG. 2 is an enlarged partial view of the schematic diagram of FIG. 1 illustrating the fluid pumps which are driven by hydraulic motors.

Referring to FIG. 2, the fluid pumps 20 and the hydraulic motor units 19 are shown in interconnected driving relation. The fluid pumps 20 preferably are liquid pumps and in particular are BLACKMER™ GTF(W) 4 pumps or possibly HXL6 positive displacement pumps currently sold by Blackmer Pumps. These pumps 20 receive fluid from a supply source and pump such fluid downstream through the distribution system. The fluid can be any suitable type such as water or fuel. Preferably, the selected process fluid is of a type wherein changes in the distribution system affect the torque through the fluid pump and motors and thereby cause a resultant effect to the system pressure.

The outlets of the pumps 22 preferably operate at the same outlet pressure so that the pumped fluid discharged from the pumps 20 passes through the coupler 26 to the downstream components of the distribution system. Preferably, the pumps 20 are operated at a speed which generates 150 psi of outlet pressure, although the particular outlet pressure may vary therefrom depending upon the particular fluid distribution application. Hence, the pumping system 11 is designed to vary the outlet pressure from the pumps 20. The particular outlet pressure may be monitored by a pressure gauge 47 which is shown proximate the pumps 20 in the schematic diagram but would be physically located on the control panel 34 next to the operator 35 (FIG. 1A).

The outlet pressure is controlled and maintained at a desired pressure in this pumping system 11 by varying the system pressure operating the motor units 19 which system pressure has a direct relationship to the pump outlet pressure generated thereby. In this regard, the pumps 20 are rotatably driven by the hydraulic motor units 19. In particular, these hydraulic motor units 19 include fixed displacement hydraulic motors 50 which are each drivingly connected to a respective one of the pumps 20 by an intermediate drive shaft 51. The hydraulic motor units 19 include inlet ports B which supply pressurized system pressure to the motors 50, and discharge ports A which allow the hydraulic fluid to flow downstream back to the main pump assembly 18 as will be described in further detail hereinafter. More particularly, a main pressure supply line 53 is provided which receives the system pressure generated by the main pump assembly 18 and supplies such system pressure to a flow-dividing valve or flow divider 54 which in turn supplies the pressurized system fluid through supply lines 55 to the inlet ports B for effecting rotational operation of the hydraulic motors 50.

The discharge ports A in turn connect to return lines 56 which connect together to a common return line 57 that returns to the main pump assembly 18. In this manner, the hydraulic motors 50 are driven or operated by the flow of hydraulic pressure fluid through these lines 53 and 55-57, and the rotational speed of the motors 50 directly relates to the system pressure being supplied to the main supply line 53 and the supply lines 55 connected to the flow divider 54. Preferably, the system pressure has a maximum operational pressure of about 5200 psi which, when supplied to the motors 50, generates a fluid pressure at the pump outlets 22 of about 150 psi. This typically is the maximum outlet pressure that is desirable for operation of the pumping system 11 of the invention, although the skilled artisan will readily appreciate that the system components may be varied to vary these operational pressures for both the system pressure and the pump outlet pressure. The system also has a minimum operational pressure of about 1500-2000 psi, which pressure can still be supplied to the motors 50 but may not be sufficient to effect rotation of the fluid pumps 20 so that even at this minimum operational pressure, the pumps do not operate and approximately 0 psi pressure is encountered at the pump outlets 22. Hence, a certain level of pressurization may be provided as the system pressure while the system is considered to be "off" since no pumping occurs.

It has been found that by creasing the pressure between the minimum operational pressure and the maximum operational pressure, an approximately linear relationship is found between the system pressure and the outlet pressure of the product pumps 20 so that varying of the system pressure also causes a correspondent variation in the pump outlet pressure. It also has been found that the system pressure also fluctuates depending upon the torque found in the pumps 20 such that when a control valve or fluid distribution valve 60 (FIG. 2) may be opened, the pressure in the distribution line drops which thereby allows the pump to spin faster and results in the hydraulic motor 50 also being able to spin faster which results in a system pressure drop. As will be described hereinafter, the pumping system 11 automatically responds to any fluctuations in system pressure by automatically adjusting the position of the aforementioned swash plate 42 in the main pump 41 to thereby increase the system pressure which increases the motor speed and thereby increases the pump outflow from the pump outlets 22 to thereby maintain the desired fluid outlet pressure. As such, the system 11 quickly reacts to minimize substantial fluctuations in process fluid pressure as the fluid distribution valves 60 and the like are opened or closed. This reaction also occurs upon closing of a fluid distribution valve 60 and prevents a pressure build-up in the system. In particular, the hydraulic motor 50 slows down as the fluid distribution valve 60 is closed and shuts off the flow of process fluid which stopping increases the system pressure in main supply line 53. The pumping system 11 when reacts thereto and de-strokes the main pump 41 by movement of the swash plate 42 to again adjust the system pressure and avoid pressure build-ups such as in the outlet lines 25 being supplied by the pumps 20. This automatic adjustment of the system pressure found in the main supply line 53 is accomplished through the control system 39 which will be described further hereinafter relative to FIGS. 3 and 4.

Lastly as to FIGS. 2 and 3, additional pressure lines 61 connect to the heat exchanger 31 (FIG. 3) and a filter unit 62.

Referring next to FIG. 3 and the operation of the variable displacement pump 41, such pump 41 is rotatably driven by the engine drive shaft 37. This pump 41 has a pump outlet 63 which connects to the main supply line 53 at discharge port P so as to supply the pressurized hydraulic fluid to the hydraulic motors 50. The hydraulic motor return line 57 connects to the return port S and supplies the pressurized fluid back to an inlet 64 of the main pump 41. The displacement of the pump 41 and the outlet pressure at pump outlet 63 is varied by the swash plate 42 wherein the provision of a swash plate and movement of a swash plate to vary pump displacement is a known structure. However, controlling the swash plate 42 is provided in an inventive manner in the pumping system 11 of the invention.

In this regard, the swash plate 42 is mechanically moved and adjusted by the mechanical connection to a control operator or swash plate control 66 which preferably is provided as a pressure-balancing solenoid diagrammatically illustrated in FIG. 3. This swash plate control 66 has a first side connection 67 and a second side connection 68 which are each configured to receive pressurized fluid therein. The swash plate control 66 is spring-biased from both sides and is operable by differential pressures being applied to the first and second sides 67 and 68 to thereby define the relative position and movement of the swash plate 42. Operation of the swash plate control 66 is effected by providing the pressures on the first and second sides 67 and 68 wherein the first side pressure is provided by an adjustable control pressure, which preferably is a destroking pressure that destrokes the pump 41 and is adjusted manually by the operator 35 to generate automatic control of the system pressure in supply line 53. The second side pressure at the second side 68 is a hydraulic pressure generated by and supplied by the aforementioned charge pump 40. In other words, the charge pump 40 supplies a charge pressure to the swash plate control 66.

To provide control to the control system 39, a control valve 70 is provided. The control valve 70 has two pressure lines 72 and 73 connected to the first and second side connectors 67 and 68 of the swash plate control 66 to thereby control the flow of the destroke or control pressure and the charge pressure. The control valve 70 also is connected to a supply line 75, which supplies the charge pressure, and is connected to a tank 76. The control valve 70 is mechanically operated by an valve operator or valve control 78 which in turn is connected by a pressurized hydraulic supply line 79 that is pressurized through the on/off actuator assembly 45 (FIG. 4). The actuator assembly 45 further includes a manual actuator 80 which is operable to actuate the control valve 70 and turn the main pumping assembly 18 on or off.

With respect to the charge pump 40 (FIG. 4), such charge pump 40 is supplied with hydraulic fluid through inlet port B which connects to an upstream supply line 81 and receives hydraulic fluid from tank 82. The charge pump 40 discharges pressurized fluid downstream through outlet port A and then to pressure line 83 which in turn connects to the aforementioned charge pressure line 75. The charge pressure line 75 supplies the hydraulic fluid at the charge pressure to the control valve 70 and then downstream to the swash plate control 66. Preferably, the charge pressure is at a substantially lower pressure than the system pressure generated by main pump 41. In this regard, the charge pressure is approximately 300 psi or such other suitable lower pressure which can be supplied to the swash plate control 66.

Figure 5:
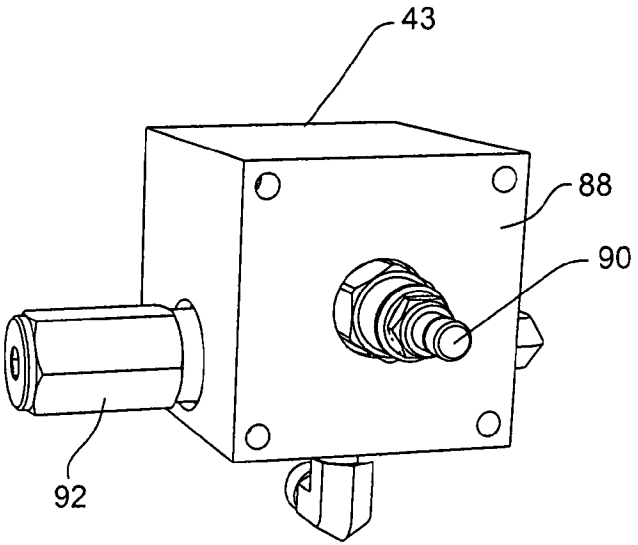
FIG. 5 is a perspective view of a control manifold provided in the control system of the invention.
Figure 6:
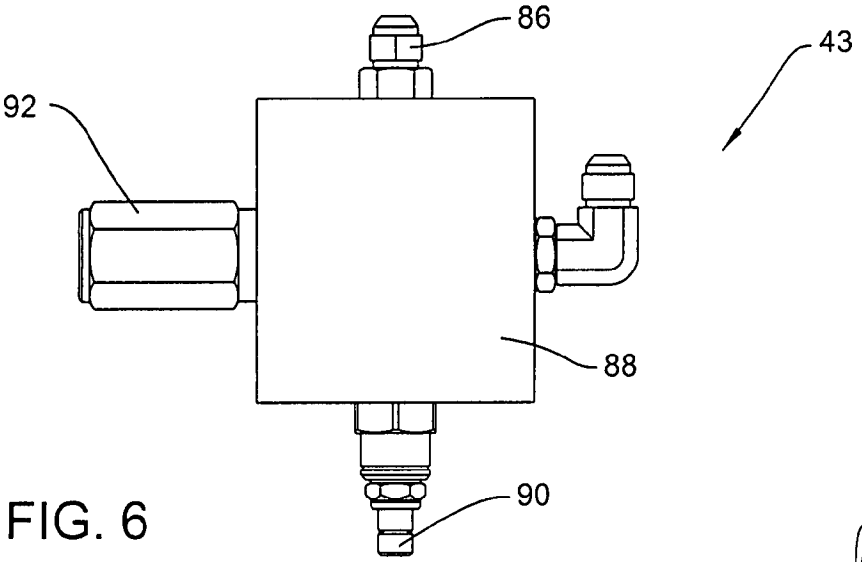
FIG. 6 is a top view of the control manifold.
Figure 7:
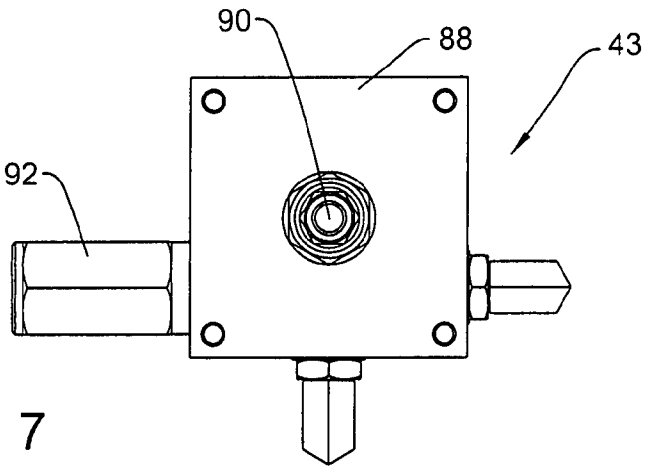
FIG. 7 is a front view of the control manifold.

As to the control or destroke pressure supplied to the first side connector 67, this control pressure is generated through and governed by the control manifold 43 referenced above. This control manifold 43 receives pressurized system fluid at the high system pressure through the supply line 84 which connects to the supply line 85 at outlet port $M_p$ (FIG. 3) which in turn connects to the control manifold 43 at inlet connector 86. The physical structure of the control manifold 43 is schematically illustrated in FIG. 3 and more specifically illustrated in FIGS. 5-7.

This manifold 43 includes a main housing 88 which has the inlet connector 86 that serves as a high pressure line into the manifold 43 and supplies such high pressure to a pressure adjustment valve, namely a pressure sequence valve 90 which is adjustable to vary the maximum system pressure of the system. In particular, the pressure sequence valve is manually adjustable to adjust the pressure in the downstream pressure line 91 which has an adjusted downstream pressure therein that then is supplied to a pressure reducer or pressure-reducing valve 92. The pressure reducer 92 and sequence valve 90 in turn connect to an outlet connector 93 that discharges through line 94 to tank 95.

The control manifold 43 thereby has a destroke outlet port 96 that supplies pressure that has been both: 1) adjusted to a set maximum pressure that may be lower or higher than the existing system pressure which may be in the range of 1500-5200 psi in the preferred system design; and 2) has been pressure reduced so that it is at a pressure comparable in magnitude to the charge pressure supplied by the charge pump 40. Hence, the outlet port 96 provides an adjusted control pressure that is supplied through supply line 97 to inlet port Y' on the main pump assembly 18 and then supplied to pressure line 98 to the first side connector 67 of the swash plate control 66. The swash plate control 66 now receives the charge pressure on one side and the adjusted control pressure on the second side which typically may be at unequal pressures. The adjusted control pressure preferably is in the range of 60-232 psi although this may vary dependent upon the system design and configuration.

Ultimately, the adjusted control pressure and the charge pressure effect displacement in the pressure-balancing solenoid, i.e. the swash plate control 66, to thereby effect adjustment of the angle of the swash plate 42 to adjust the pump output from the main pump 41. This then has a direct effect upon the system pressure and actually causes a corresponding change, i.e. increase or decrease, in the system pressure.

More particularly, when the engine 17 operates, this causes rotation of the main pump 41 and the charge pump 40 with the charge pump 40 generating the above-described charge pressure. When the on/off actuator 45 is turned on, the valve control 78 is actuated through pressure line 79 to operate the control valve 70 and supply the charge pressure through line 73 to the swash plate control 66. Preferably, this fully strokes the swash plate 42 and main pump 41 generates hydraulic fluid pressure up to the system pressure. This system pressure is then supplied through line 85 to the control manifold 43 and specifically to the sequence valve 90. The sequence valve 90 is normally closed but is set to a maximum pressure. When the system pressure reaches the preset max pressure, the sequence valve 90 opens, and generates the control pressure supplied to the first side connector 67 of the pressure balancing solenoid 66 when then operates to destroke the pump 41. The control pressure therefore preferably is a destroking pressure that affects the stroke of the main pump 41 and the output therefrom. Once this control pressure is supplied, the solenoid 66 is subject to both the destroking control pressure and the charge pressure which tends to stroke the pump so that these competing pressure adjust the main pump 41 to a point less than full stroke or in other words, to the point where the system pressure is maintained at the maximum set pressure. The sequence valve 90 may quickly cycle between open and closed to thereby continually adjust the swash plate 42 and maintain the system pressure at the set pressure.

Hence, in a first aspect, the system pressure in supply line 53 directly correlates to but controls the outlet pressure at the pumps 20, wherein the system pressure is controlled by the pressure sequence valve 90 and the control manifold 43. This allows the maximum system pressure to be set. The sequence valve 90 typically is physically located on the control panel 34 proximate the pressure gauge 47 so that as the sequence valve 90 is manually adjusted, i.e. the knob thereof is manually rotated, the direct effect of these changes in the system pressure will be seen as changes in the pump outlet pressure, although the sequence valve 90 has no direct connection or direct control to the pump outlet pressure since the sequence valve 90 only controls hydraulic pressure and does not directly control process fluid pressure or even measure same. To set the system pressure, the operator 35 manually adjust the sequence valve 90 while watching the process fluid pressure gage 47 so that it appears the operator 35 is directly setting the process fluid pressure, although in actuality, the hydraulic system pressure is being set which causes an indirect adjustment to the process fluid pressure through the interconnected motors 50 and pumps 20. As such, the hydraulic system pressure is used as the control means for causing corresponding changes in the process fluid pressure. Further, the sequence valve 90 and the connection to the pressure balancing solenoid 66 sets the maximum system pressure or operational pressure and maintains such pressure at a relatively constant value.

In a second aspect, this arrangement also provides for virtually immediate changes in system pressure based upon changes in operation of the pumps 20 and the flow of the process fluid therethrough which may be affected by opening and closing of the fluid distribution valve 60. In this regard, as the valve 60 is opened or closed, this will affect or cause changes in the torque of the pumps 20 and associated motors 50 which thereby will affect changes in the system pressure. These changes in the system pressure such as in line 53 also transmit through the drive and control system and specifically the control system wherein such system pressure changes pass directly to the control manifold 43 which will cause the sequence valve 90 to open or close. This therefore varies the destroking control pressure being transmitted to the swash plate control 66. This is accomplished by the sequence valve 90 being normally closed until the max system pressure is reached. The actual level of the max system pressure does vary depending upon manual adjustment of the sequence valve 90. If the system pressure during operation drops below the maximum pressure, this would then cause the sequence valve to close which would reduce the destroking control pressure which would thereby cause the swash plate to move and increase the pump output to again increase the system pressure back up to the maximum system pressure. When the max system pressure is again reached, the sequence valve 90 would again re-open and pressurize the first side of the pressure-balancing solenoid 66 to de-stroke the pump so as to prevent over-pressuring of the lines 53.

This system reacts very quickly to changes in the system pressure so as to quickly increase or decrease any fluctuations in pressure to the maximum pressure desired. Hence, the outlet pressure from the fluid pumps 20 is maintained at the desired pressure, and changes in conditions in the process fluid lines, such as by opening and closing of valves, are virtually unnoticeable due to the quick reaction of the destroking of the main pump 41 as accomplished by the control system 39.

The drive and control systems as illustrated in FIG. 1B are essentially all hydraulic so that the pumping system 11 can be continuously operated without requiring or relying upon separate electronic control systems or sensors to be able to maintain such system in operation. While electronic monitoring and safety systems might still be provided to enhance the pumping system 11, the loss or omission of such electronic monitoring or safety systems would not prevent the pumping system 11 from operating. This pumping system 11 merely requires operation of the engine or other power source 17, and as long as this power supply operates to drive the main pump 41 and charge pump 40, the motor units 19 and the associated process fluid pumps 20 are also operated thereby.

Although particular preferred embodiments of the invention have been disclosed in detail for illustrative purposes, it will be recognized that variations or modifications of the disclosed apparatus, including the rearrangement of parts, lie within the scope of the present invention.

What is claimed is:

1. A hydraulic pumping system for distribution of process fluids:

a process fluid pump for receiving a process fluid and pumping said process fluid from a pump outlet for distribution of said process fluid, said fluid pump discharging said process fluid from said pump outlet at an outlet pressure;

a hydraulic motor which is drivingly connected to said fluid pump and receives a pressurized hydraulic system fluid to drive said fluid pump;

a main pump having a pump output wherein said system fluid is discharged from said main pump at a system pressure defined by operation of said main pump, said main pump supplying said system fluid to said hydraulic motor, said main pump being a variable displacement hydraulic pump with said pump output being variable to vary said system pressure wherein changes to said system pressure effect corresponding changes to said outlet pressure of said process fluid, said main pump including a mechanical adjustment device to vary said system pressure by varying said pump output of said main pump; and a control system for adjusting said main pump comprising a hydraulic control actuator operatively connected to said mechanical adjustment device to vary said pump output, said control system including a charge pump which supplies a hydraulic charge fluid at a charge pressure to said control actuator, said control system further including, a pressure controller which receives said system fluid at said system pressure and includes a pressure adjustment device which is variable to set a maximum system pressure and which supplies hydraulic fluid at a control pressure to a first inlet of said control actuator wherein said control pressure corresponds to and varies with a maximum system pressure, said control actuator receiving said charge pressure and said control pressure in balancing relation to selectively adjust said mechanical adjustment device of said main pump to vary said system pressure from said pump output in correspondence to said control pressure and maintain said system pressure at said maximum system pressure.

2. The hydraulic pumping system according to claim 1, wherein said control actuator is a pressure balancing solenoid which moves said mechanical adjustment device of said main pump, said control actuator further including a second inlet, and said first inlet receiving said control pressure and said second inlet receiving said hydraulic charge fluid at said charge pressure wherein relative magnitudes of said control pressure and said charge pressure vary said mechanical adjustment device to adjust said pump output.

3. The hydraulic pumping system according to claim 2, wherein said mechanical adjustment device is a swath plate which is movable to vary a stroke of said main pump to increase and decrease said pump output.

4. The hydraulic pumping system according to claim 3, wherein said charge pressure tends to move said swash plate toward full stroke by said control actuator to increase said pump output and said control pressure tends to move said swash plate away from full stroke to decrease said pump output.

5. The hydraulic pumping system according to claim 1, wherein, in the absence of system pressure and said control pressure corresponding thereto, said charge pressure moves said mechanical adjustment device of said main pump to increase said pump output and generate said system pressure.

6. The hydraulic pumping system according to claim 5, wherein said control pressure in the presence of said system pressure acts to decrease said pump output to adjust said system pressure to said maximum system pressure.

7. The hydraulic pumping system according to claim 1, wherein said control actuator is a pressure balancing solenoid, and said pressure adjustment device is a normally closed, hydraulic sequence valve which is set to open at said maximum system pressure, said sequence valve automatically opening and closing relative to said maximum system pressure to selectively govern said control pressure and maintain said system pressure by hydraulically varying said pump output.

8. The hydraulic pumping system according to claim 1, wherein said control system includes a pressure reducer such that said control pressure and said charge pressure are at a low pressure and said system pressure is at a high pressure.

9. The hydraulic pumping system according to claim 8, wherein said motor and said fluid pump require a minimum system pressure to operate said fluid pump, said system pressure being provided at or above said minimum system pressure to operate said motor and said fluid pump, and said charge pressure and said control pressure being lower than said minimum system pressure.

10. A hydraulic pumping system for distribution of process fluids:

a process fluid pump for receiving a process fluid and pumping said process fluid from a pump outlet for distribution of said process fluid, said fluid pump discharging said process fluid from said pump outlet at an outlet pressure;

a hydraulic motor which is drivingly connected to said fluid pump and receives a pressurized hydraulic system fluid at an adjustable system pressure to drive said fluid pump such that said outlet pressure of said fluid pump varies in accordance with said system pressure;

a main pump having a pump output wherein said system fluid is discharged from said main pump at said system pressure which is defined by operation of said main pump, said main pump supplying said system fluid to said hydraulic motor, said main pump being a variable displacement hydraulic pump with said pump output being variable to vary said system pressure wherein changes to said system pressure effect corresponding changes to said outlet pressure of said process fluid, said main pump including a mechanical swash plate which is movable to vary pump stroke which varies said system pressure of said pump output;

an engine driving said main pump; and a control system for adjusting said main pump comprising a hydraulic control actuator operatively connected to said swash plate to vary said pump output, said control actuator including first and second pressure inlets, and said control system including a charge pump which supplies a hydraulic charge fluid at a charge pressure to said second inlet, said control system further including a pressure controller which receives said system fluid at said system pressure and includes a pressure adjustment device which is variable to set a maximum system pressure and which supplies hydraulic fluid at a control pressure to said first inlet of said control actuator wherein said control pressure corresponds to and varies with said maximum system pressure, said control actuator receiving said charge pressure and said control pressure in balanced relation to selectively adjust said swash plate of said main pump to vary said system pressure from said pump output in correspondence to said control pressure and maintain said system pressure at said maximum system pressure, said charge pressure moving said swash plate toward full stroke by said control actuator to increase said pump output and said control pressure moving said swash plate away from full stroke to decrease said pump output.

11. The hydraulic pumping system according to claim 10, wherein said swash plate is movable to vary a stroke of said main pump to increase and decrease said pump output.

12. The hydraulic pumping system according to claim 10, herein, in the absence of system pressure and said control pressure corresponding thereto, said charge pressure moves said swash plate of said main pump to increase said pump output and generate said system pressure.

13. The hydraulic pumping system according to claim 12, wherein said control pressure in the presence of said system pressure acts to decrease said pump output to adjust said system pressure to said maximum system pressure.

14. The hydraulic pumping system according to claim 10, wherein said control actuator is a pressure balancing solenoid, and said pressure adjustment device is a normally closed, hydraulic sequence valve which is set to open at said maximum system pressure, said sequence valve automatically opening and closing relative to said maximum system pressure to selectively govern said control pressure and maintain said system pressure by hydraulically varying said pump output.

15. The hydraulic pumping system according to claim 10, wherein said control system includes a pressure reducer such that said control pressure and said charge pressure are at a low pressure and said system pressure is at a high pressure.

16. The hydraulic pumping system according to claim 15, wherein said motor and said fluid pump require a minimum system pressure to operate said fluid pump, said system pressure being provided at or above said minimum system pressure to operate said motor and said fluid pump, and said charge pressure and said control pressure being lower than said minimum system pressure.

17. A method for controlling a hydraulic pumping system for distribution of process fluids at a defined fluid pressure:

providing a process fluid pump and a hydraulic motor driving said fluid pump;

supplying a hydraulic system fluid at an elevated system pressure to said motor to operate said motor and drive said fluid pump, said fluid pump receiving said process fluid and pumping said process fluid from a pump outlet for distribution of said process fluid from said pump outlet at an outlet pressure;

providing a main pump having a pump output by which said system fluid is discharged from said main pump at said system pressure, which is defined by operation of said main pump, for said supplying of said system fluid to said hydraulic motor, said main pump being a variable displacement hydraulic pump with said pump output being variable to vary said system pressure wherein changes to said system pressure effect corresponding changes to said outlet pressure of said process fluid, said main pump including a mechanical adjustment device to vary said system pressure by varying said pump output of said main pump;

adjusting said pump output of said main pump by a hydraulic control actuator operatively connected to said mechanical adjustment device to vary said pump output, said control actuator including first and second pressure inlets, said adjusting step comprising the steps of:

supplying a hydraulic charge fluid at a charge pressure to said control actuator;

setting a maximum system pressure by supplying said system fluid to a pressure controller which receives said system fluid at said system pressure and includes a pressure adjustment device which is variable for said setting of said maximum system pressure;

supplying a hydraulic fluid from said pressure controller at a control pressure to said control actuator wherein said control pressure corresponds to said maximum system pressure set by said pressure controller, said control actuator receiving said charge pressure and said control pressure in balancing relation to adjust said mechanical adjustment device; and thereafter, selectively adjusting said mechanical adjustment device of said main pump by said control actuator to vary said system pressure from said pump output in correspondence to said control pressure and maintain said system pressure at said maximum system pressure.

18. The method according to claim 17, wherein, in the absence of system pressure and said control pressure corresponding thereto, supplying said charge pressure to said control actuator to move said mechanical adjustment device of said main pump to increase said pump output and generate said system pressure.

19. The method according to claim 18, wherein said control pressure, in the presence of said system pressure, acts to decrease said pinup output to adjust said system pressure to said maximum system pressure.

20. The method according to claim 19, wherein said mechanical adjustment device of said main pump is a swash plate, said adjusting step comprising the step of moving said swash plate to vary a stoke of said main pump to increase and decrease said pump output.

* * * * *